US008281636B2

(12) United States Patent
Möck et al.

(10) Patent No.: US 8,281,636 B2
(45) Date of Patent: Oct. 9, 2012

(54) HEADING DEVICE

(75) Inventors: Jörg Möck, Sonnenbühl (DE); Dirk Taigel, Reutlingen (DE)

(73) Assignee: Wafios Aktiengesellschaft, Reutlingen (DE)

( * ) Notice: Subject to any disclaimer, the term of this patent is extended or adjusted under 35 U.S.C. 154(b) by 135 days.

(21) Appl. No.: 12/788,838

(22) Filed: May 27, 2010

(65) Prior Publication Data

US 2010/0300173 A1 Dec. 2, 2010

(30) Foreign Application Priority Data

May 28, 2009 (DE) ..... 10 2009 022 957

(51) Int. Cl.
*B21D 41/00* (2006.01)
*B21J 5/08* (2006.01)

(52) U.S. Cl. ..... 72/312; 72/316; 72/318; 72/370.1; 29/252

(58) Field of Classification Search ..... 72/312, 72/316, 318, 354.2, 356, 357, 358, 370.1, 72/370.06, 377, 402; 29/252
See application file for complete search history.

(56) References Cited

U.S. PATENT DOCUMENTS

| | | | | |
|---|---|---|---|---|
| 1,983,618 | A * | 12/1934 | Lamond | 72/357 |
| 2,464,510 | A | 3/1949 | Hull | |
| 4,838,062 | A * | 6/1989 | Prenn | 72/41 |
| 5,709,121 | A * | 1/1998 | Camping | 72/316 |
| 6,508,097 | B2 * | 1/2003 | Ose | 72/312 |
| 6,708,548 | B2 * | 3/2004 | Ehrke et al. | 72/312 |
| 7,237,420 | B2 * | 7/2007 | Berghaus | 72/318 |

FOREIGN PATENT DOCUMENTS

| | | |
|---|---|---|
| CH | PS 477 929 | 10/1969 |
| CN | 2352285 Y | 12/1999 |
| CN | 2526103 Y | 12/2002 |
| DE | 26 29 796 | 12/1980 |
| FR | 2.231.449 | 12/1974 |

* cited by examiner

*Primary Examiner* — David B Jones
(74) *Attorney, Agent, or Firm* — Patterson Thuente Christensen Pedersen, P.A.

(57) ABSTRACT

In a heading device for elongate workpieces having a hydraulic chucking unit and an shaping ram, which is movable axially from a retracted idle position against the workpiece, the chucking unit comprises a housing having a sliding body which is hydraulically displaceable in the axial direction of the workpiece from a starting position into a clamping position (and vice versa), in which at least two chucking segments which are situated uniformly around the workpiece are inserted, which, on their side facing toward the shaping ram, press against a locking plate which is inserted into the housing and can be fixed therein, are movable radially against the workpiece by a displacement of the sliding body in its clamping position, and each receive at least one clamping jaw, which can be pressed by the chucking segment holding it radially against the workpiece for its clamping. The shaping ram carries a forming tool for upsetting the workpiece on the extension side, using which it can be pressed against the head of the workpiece protruding axially from the clamping jaws upon extension through an opening provided in the locking plate, and is moved completely out of the opening in the locking plate with its forming tool in its retracted idle position.

21 Claims, 3 Drawing Sheets

HEADING DEVICE

This application claims priority to German Patent Application No. 10 2009 022 957.4 filed on May 28, 2009, said application is incorporated herein by reference in its entirety.

FIELD OF THE INVENTION

The invention relates to a heading device for elongate workpieces, such as bars, pipes, wires, or the like, and it particularly relates to a cold heading device.

BACKGROUND OF THE INVENTION

Such heading devices are used for the purpose of shaping the ends of bar-shaped workpieces, i.e., pipe or bar ends, the pipe wall or the bar ends being thickened, up to this point, one or more other local thickened areas (flares) still also additionally being provided in the course of the elongate workpiece by upsetting.

A hydraulic cold heading device is described in CH-PS 477 929, the device known therefrom having a very large and complicated overall construction, however, in which the use of installing tools is necessary to perform a tool change and the tool change itself is relatively cumbersome.

A hydraulic heading device for pipes and bars is known from DE 2629796 C, in which, however, a heating unit is used for heating the workpiece to be formed and thus forming is performed with heating. The heating occurs via two single-turn induction coils, which allow a precisely defined heating zone having predefined temperature gradients to be achieved, the front end of the part to be upset being heated more strongly than the remaining heating zone. This known heading device is complex in construction, operation, and in the event of a tool change because of the installed heating unit.

A further known cold heading device can be inferred from FR 2 231 449 A. This hydraulic device operates using multiple forming areas, whereby a unit having a very large overall construction results. A tool change, when it is to be performed, is relatively complex.

SUMMARY OF THE INVENTION

Embodiments of the invention have the feature and vantages over the prior art of providing a cold heading device, which allows improved operability, a reduction of the equipping time, and a simple and rapid replacement of the clamping jaws without requiring the use of special installing tools.

This is achieved according to an embodiment of the invention by a heading device for elongate workpieces, such as bars, pipes, wires, or the like, which has a hydraulically actuated chucking unit and an forming or shaping ram, which is axially movable against the workpiece from a retracted idle position, the chucking unit comprising a housing having a sliding body which is displaceable in the axial direction of the workpiece from a starting position into a clamping position (and vice versa), in which at least two chucking segments which are situated uniformly around the workpiece are inserted, which, on their side facing toward the shaping ram, press against a locking plate which is inserted into the housing and can be fixed therein, are movable radially against the workpiece by a displacement of the sliding body in its clamping position, and each receive at least one clamping jaw, which can be pressed by the chucking element holding it radially against the workpiece for its clamping, furthermore, the ram also carrying a forming tool for shaping the workpiece on the extension side, using which it can be pressed against the head of the workpiece protruding axially from the clamping jaws upon extension through an opening provided in the locking plate, and is moved completely out of the opening of the locking plate with its forming tool in its retracted idle position.

The cold heading device according to the invention is easily operable, does not require a large amount of space, and a tool change can be performed particularly easily, simply, and rapidly therein, and without a special installing tool.

For the tool change, it is only necessary in the heading device according to the invention to push the locking plate inserted into the housing out of the housing after disengaging its fixing, after which the chucking segments having the clamping jaws contained therein, which previously pressed against the locking plate, may be pulled out individually and without difficulty from this (rear) side of the housing, because they are only still inserted into the sliding body enclosing them. If a chucking element is removed, each clamping jaw which is received therein can also be removed and a new clamping jaw (having a new shaping for a modified tool) can be inlaid without difficulty. Subsequently, the two chucking elements having inlaid (new) clamping jaws are plugged and/or inserted back into the housing and the sliding body provided therein and subsequently the tool changing procedure is ended by inserting the locking plate back into the housing (and subsequently fixing it). Because all parts which are required for the exchange of the tools may be pulled out of the housing when the locking plate is removed, because they are all only inserted or plugged and are not fastened anywhere therein, the tool change can be performed rapidly and also easily. The equipping time is also significantly reduced in the heading device according to the invention in relation to the known devices, because the exchange of the clamping jaws can be performed rapidly. In addition, no engagement in the hydraulic systems of the device according to the invention is necessary in the event of an exchange of the clamping jaws.

Finally, the heading device according to the invention also has a relatively space-saving construction as a result of the configuration of the individual parts of the chucking unit in the interior of the housing, in the case of the invention, the axial movement of the sliding body being converted into a radial chucking movement of the chucking segments and thus a configuration of the latter in a space-saving manner inside the sliding body being possible.

It has proven to be particularly advantageous in the case of the invention if two chucking segments are provided and two clamping jaws situated axially one behind another in a corresponding receptacle are seated in each thereof, the clamping jaws again preferably being attached so they are axially displaceable to one another while forming an axial intermediate space situated between them and being able to be axially pressed apart using at least one compression spring between them. With this design, the possibility exists that upon shaping the workpiece, a thickened area is implemented not only on its head, but rather also in the course of its length in the area between the two clamping jaws during the shaping. This is performed in that upon incidence of the shaping ram on the head of the workpiece, firstly the chucking elements of the two clamping jaws, which engage behind the head of the workpiece, may slide axially within their receptacles in the particular sliding body in the direction toward the second clamping jaws still provided therein with reduction of the intermediate space between them under the action of the axial upsetting force during upsetting of the workpiece, whereby the workpiece axial clamped by them cannot move axially as a result of the clamping effect of the second clamping jaws, so that as a result of the reduction of the intermediate space and the fixed clamping of the workpiece between the first clamping jaws, the material of the workpiece provided inside the intermediate space is radially thickened until the first clamping jaws come to a stop with their sliding movement. The possibility also exists of providing an axial recess in each first clamping jaw on the side of the first clamping jaws facing toward the particular downstream second clamping jaws, which fixes the upset material form of the section between both clamping jaws, so that during the shaping procedure, the first clamping jaws may be pushed until contact against the second clamping jaws and the upset thickened area of the material is formed within this recess in the first clamping jaws.

A particularly simple construction of the device according to the invention also results if the hydraulic cylinder which actuates the shaping ram is fastened on the side of a terminus plate facing away from the housing of the device, which is in turn, viewed in the movement direction of the shaping ram, situated spaced apart at a distance from the locking plate. This results in the great advantage that in the case of a tool change, after the removal of the locking plate from the housing, the existing access space which is then provided for exchanging the chucking elements, etc., is relatively large. The distance between terminus plate and locking plate is particularly preferably selected so that it is greater than the axial length of each individual chucking segment. This allows each chucking element to be able to be removed from its location in the housing parallel thereto after the locking plate is removed, without lateral tilting of the chucking element being required in the course of the pushing out.

To convert the axial displacement movement of the sliding body in the housing into a radial chucking movement of the chucking elements, it is advantageous if each chucking element has two guide strips lying parallel to one another on its top side and on its bottom side, which each run oriented at an acute angle to the displacement direction of the sliding body and which each engage positively and displaceably in an associated guide groove implemented in the sliding body. A very space-saving conversion of the axial movement of the sliding body into a radial chucking movement of the chucking elements is thus possible.

In the heading device according to the invention, the housing is advantageously provided on its front side opposite to the locking plate with a lid, which has a central opening, through which the workpiece can also be inserted into the housing, the sliding body having a stop surface attached thereon pressing against this lid in its starting position. A guide and centering unit for the workpiece is preferably attached on the side of the lid facing away from the housing. This guide and centering unit advantageously comprises two pivot levers, which are attached to the opening of the lid, having guide jaws, which are pivotable from an folded-out idle position into a centering position pressing against the workpiece (and vice versa), both pivot levers again preferably being connected to the sliding body so they are pivotable, in such a way that they assume their folded-out idle position when the sliding body is in its starting position, but are transferred into their folded-in centering position upon movement of the sliding body into its clamping position (and vice versa). It is thus ensured that the sliding body is located in its starting position when a new workpiece is inserted through the guide and centering unit into the housing, which is centered and held upon movement of the sliding body in its clamped position on the outer side of the lid by the two pivot levers by their folded-in centering position.

Another preferred possibility for actuating the two pivot levers can also be achieved, however, if they are both pivotable independently of the position of the sliding body, a separate pivot drive being able to be provided for this purpose, for example. This allows the workpiece, if it is already inserted into the housing, to be centered and held by both pivot levers already at a point at time at which the sliding body has not yet begun its axial displacement.

It is again advantageous in a heading device according to the invention if the entire device is attached to a separate framework and is movable thereon in the displacement direction of the shaping ram. This movement axis allows particularly great flexibility during use of the upsetting device, in that, for example, a larger free space can be provided between a bending machine and the heading device according to the invention. However, this simultaneously prevents the workpiece from having to be positioned and/or moved axially relative to the upsetting device in the axial direction before and after the upsetting. This proves to be unfavorable in particular if endless coiled material is processed on a bending machine, which is fundamentally to move backward as little as possible. The workpiece can thus theoretically be positioned in a specific position in front of the retracted heading device according to the invention, which is then moved forward via its drive, forms the workpiece and is subsequently retracted again. This also even allows the feed of the workpieces through a feed unit moved transversely to the axial direction of the workpieces (for example, a rotating robot having processing units attached in a circle around it, or a moving feed unit having multiple processing stations attached parallel to one another, inter alia).

BRIEF DESCRIPTION OF THE DRAWINGS

The invention is fundamentally explained in greater detail hereafter on the basis of the drawings for exemplary purposes. In the figures.

DETAILED DESCRIPTION

Figure 1:
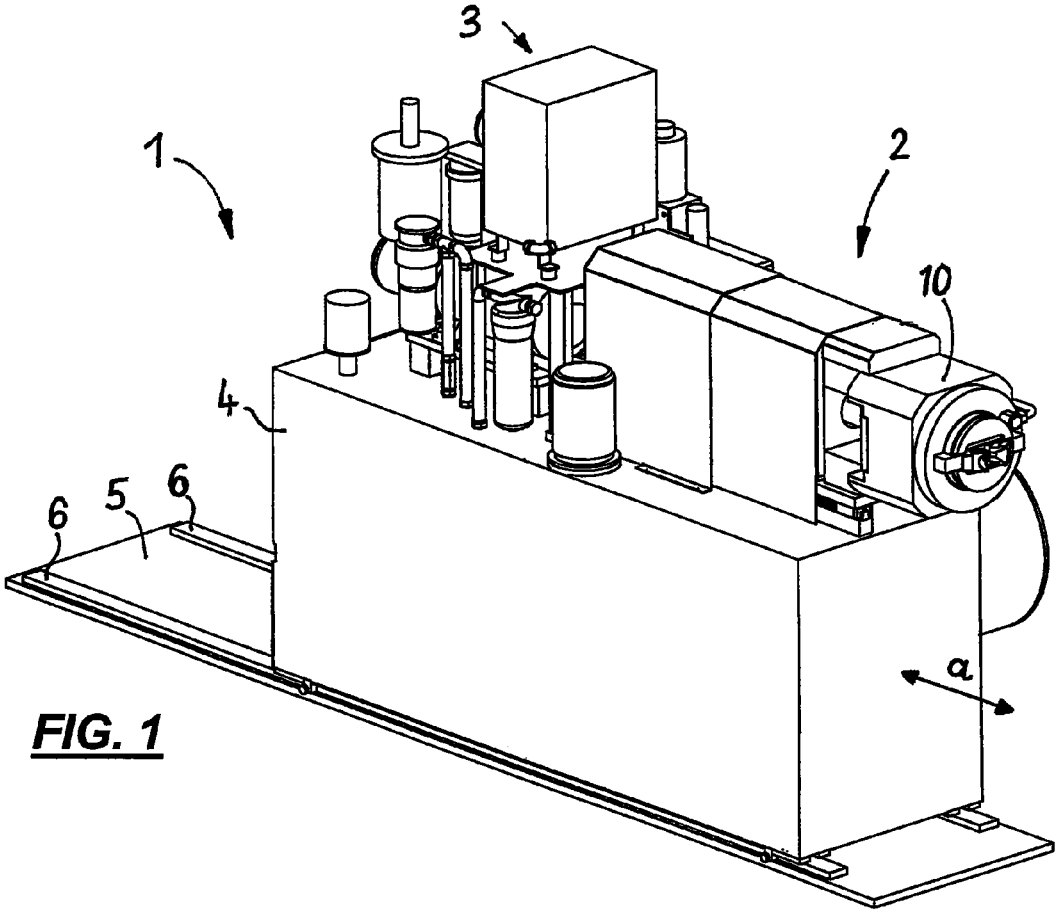
FIG. 1 shows a perspective overall view of a heading device according to the invention.

FIG. 1 shows a perspective view of a heading device 1, which essentially comprises two main parts, namely a shaping unit 2 and a hydraulic unit 3. The latter is a device known per se, which is used for the purpose of providing the required pressures (such as pressing forces up to 600 kN) in the present system.

The shaping unit 2 and the hydraulic unit 3 are attached on a framework 4, which can in turn be moved or offset along a floor plate 5, in the direction a corresponding to the orientation of the longitudinal axis of the workpieces to be processed and also the longitudinal axis of the shaping unit 2 along guides 6, which are fastened on the floor plate 5.

Figure 2:
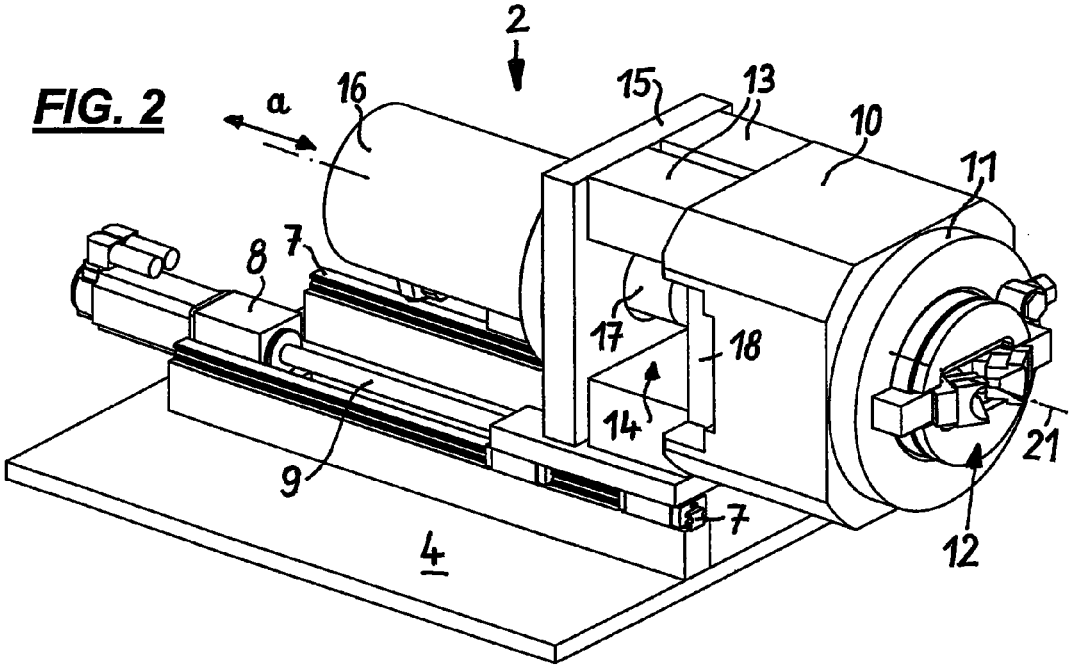
FIG. 2 shows an enlarged perspective view of the shaping unit from FIG. 1.

A perspective enlarged illustration of the shaping unit 2 is shown in FIG. 2, which is situated on the framework 4, which is only shown, purely schematically, in the form of a common base plate in FIG. 2.

According to FIG. 2, the shaping unit 2 is seated on the framework 4 on two parallel longitudinal rails 7, along which it can again be moved in the direction a via a motor 8 and a spindle drive 9. This additional movement axis in comparison to typical devices allows great flexibility during use of the shaping unit 2. This also prevents the workpiece from having to be positioned further in the axial direction and/or axially moved in relation to the shaping unit 2 before and after the shaping, which is particularly unfavorable if endless coil material is processed on a bending machine, which is fundamentally to be moved backward as little as possible. The workpiece can thus be positioned in a specific position in front of the shaping unit 2, which is retracted on the longitudinal rails 7, this unit then being able to be moved forward, upset the workpiece, and subsequently be retracted again. Thus the feed of the workpieces can thus also be performed by a feed unit moved transversely to the axial direction of the workpieces (such as a rotating robot having processing units attached in a circle around it, or a moving feed unit having multiple processing stations attached parallel to one another, inter alia).

Still further details of the shaping unit 2 can be inferred from FIG. 2:

Firstly, it comprises a housing 10, which has a lid 11 and a guide and centering unit 12 on its front side (facing toward the workpiece feed). On the opposing (rear) side, the housing 10 is attached via connecting webs 13, which provide a free space 14, to a terminus plate 15. A hydraulic cylinder 16, whose ram 17 forms the shaping ram and carries a forming tool 24 on its extension-side end, is fastened on the side of the terminus plate 15 facing away from the housing 10.

Figure 5:
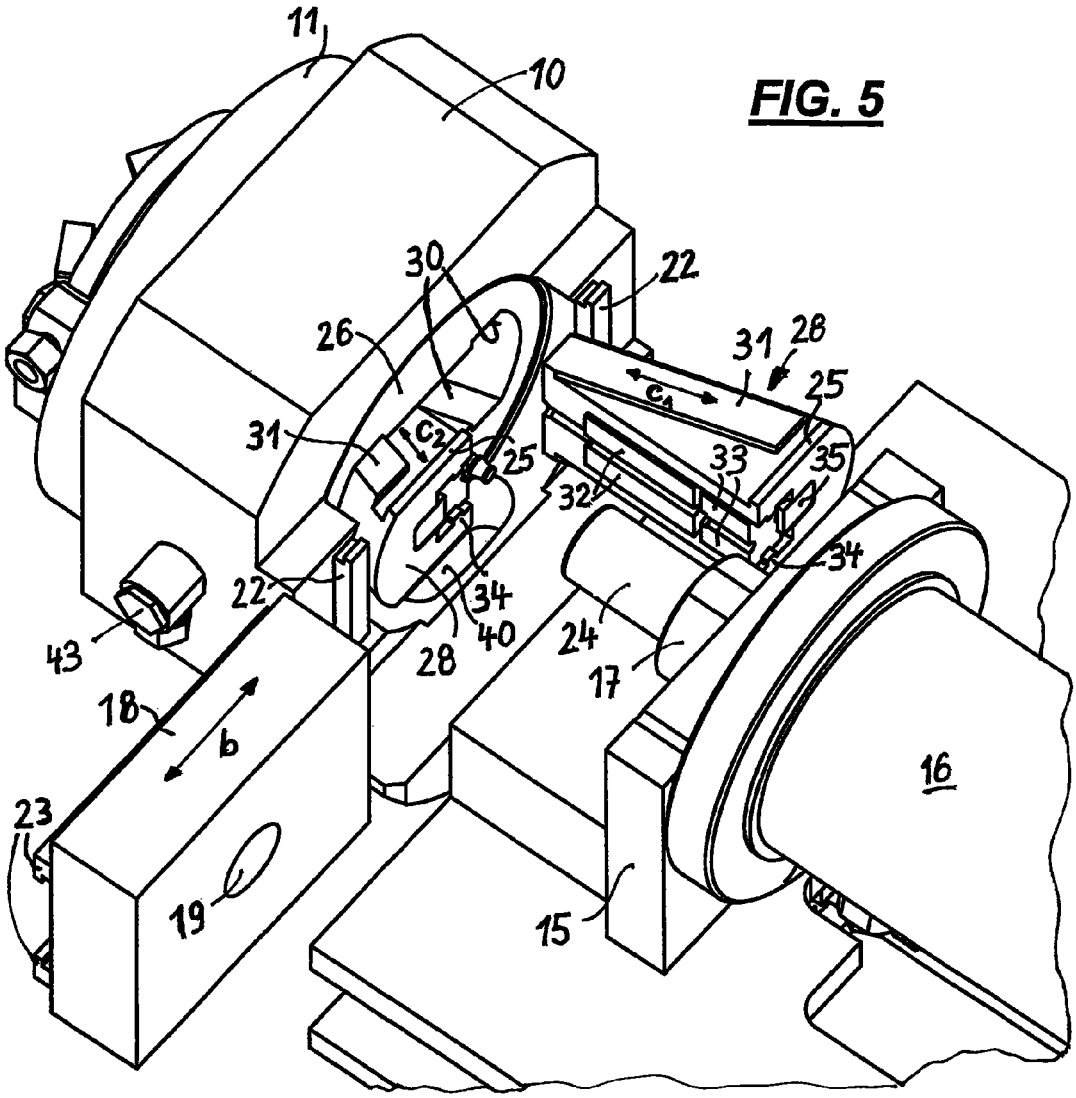
FIG. 5 shows an enlarged detail view of a detail of the shaping unit according to FIG. 2 to illustrate the conditions in the case of a tool change.

Furthermore, a locking plate 18 is insertable into the housing 10, which has a central hole 19, as can be inferred particularly well from the illustration of FIG. 5, through which the forming tool 24 can be pressed against the head of the workpiece lying behind it for shaping upon extension of the shaping ram 17.

As is recognizable from FIG. 1, both the connecting webs 13 and the terminus plate 15 are covered on top in the installed, operationally-ready state of the heading device 1, and the hydraulic cylinder 16 and the motor 8, which causes the mobility of the shaping unit 2 along the longitudinal rails 7, and the spindle drive 9 are externally protected using a cover pulled over them.

Figure 3:
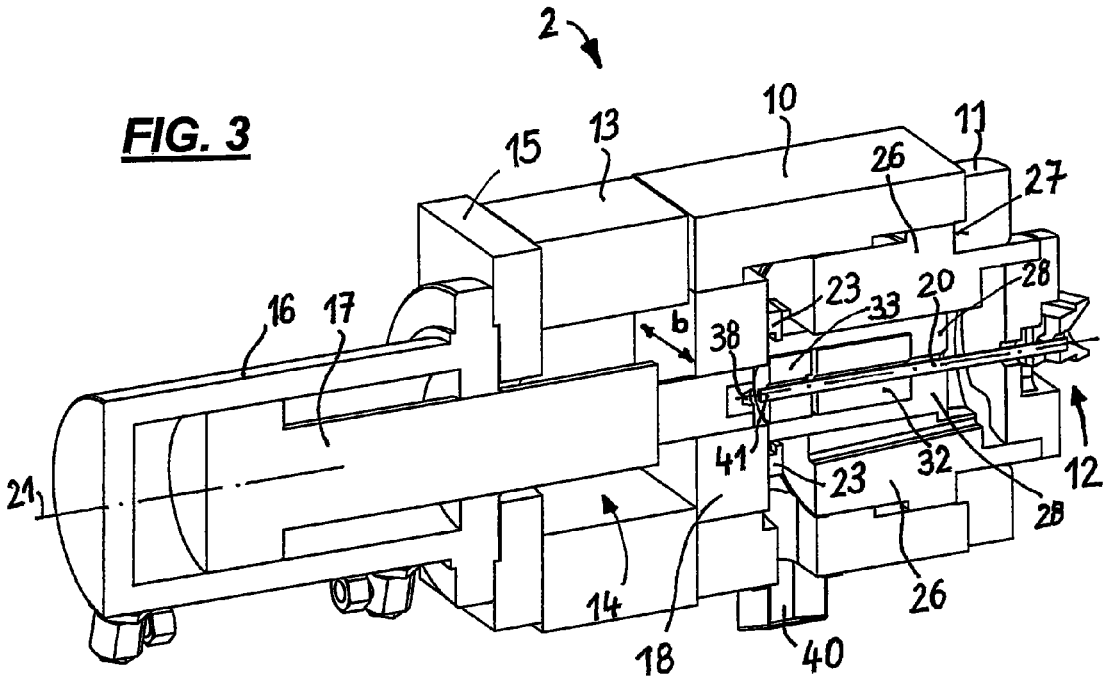
FIG. 3 shows a vertical section through the shaping unit according to FIG. 2, having retracted shaping ram and position of the sliding body in its starting position.
Figure 4:
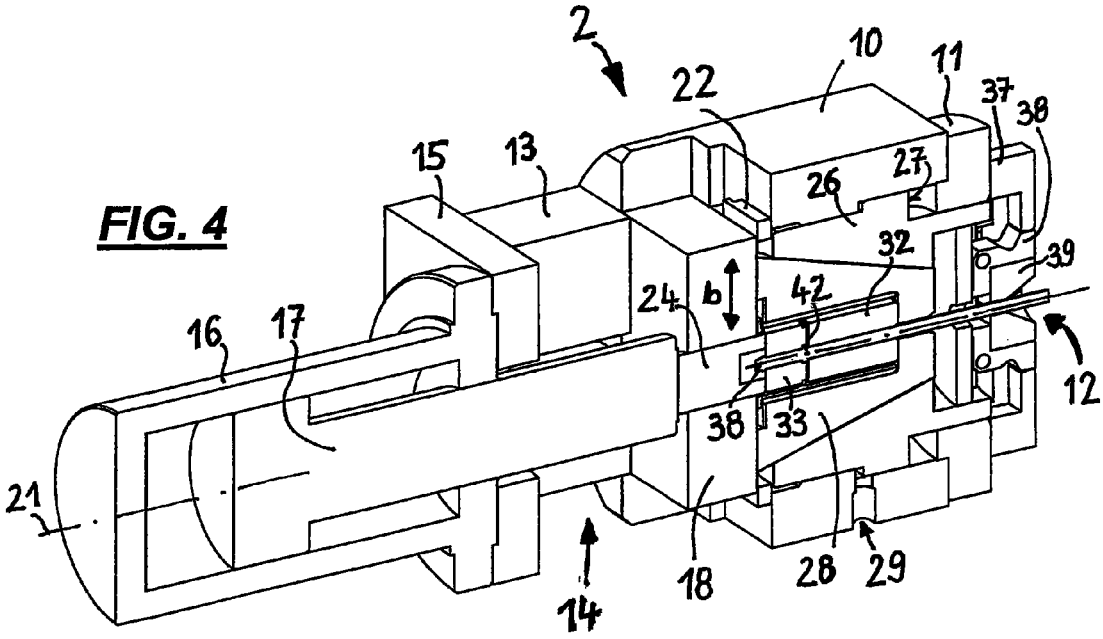
FIG. 4 shows a horizontal section through the shaping unit according to FIG. 2, the shaping ram being located in its extended upsetting position and the sliding part being located in its clamping position here.

FIG. 3 shows the shaping unit 2 in a vertical section (perpendicular to the floor plate 5), along the longitudinal central axis 21 of the shaping unit 2. The open position of the guide and centering unit 12 is shown here, i.e., the position in which workpieces 20 may be introduced. In contrast, FIG. 4 shows a horizontal section of the shaping unit 2, the section plane running parallel to the floor plate 5 and through the longitudinal central axis 21 (FIG. 2) of the shaping unit 2. The closed position of the tools is shown in FIG. 4, i.e., the shaping position.

On its rear end, i.e., facing toward the shaping ram 17, the housing 10 is provided with guide angles 22 (FIG. 4), with which complementary shaped guide flanges 23 (FIG. 3) on the locking plate 18 are engaged so they are displaceable, the direction of the displacement being specified in FIGS. 4 and 5 by the arrow b.

As already shown by the illustration from FIG. 2, the locking plate 18 is situated so that it can be inserted laterally into the housing 10. However, for the lateral removal of the locking plate 18, the shaping ram 17 of the hydraulic cylinder 16 must be brought into an entirely retracted idle position, in which the forming tool 24 fastened on its extension end is completely withdrawn from the hole 19 in the locking plate 18. This idle position of the shaping ram 17, which must only be assumed when the locking plate 18 is removed from the housing 10, is shown in the illustration of FIG. 5, but not in the sections of FIGS. 3 and 4.

Furthermore, an axially hydraulically displaceable sliding body 26 is attached in the housing 10, which is movable from a starting position, which is shown in FIG. 3 and in which it presses against an annular peripheral radial stop surface 27 on the lid 11, into a clamping position shown in FIG. 4.

Two chucking segments 28 are inserted into the interior of the sliding body 26. Furthermore, a hole 29 is introduced into the housing 10, using which hydraulic fluid for the axial displacement of the sliding body can be introduced into the housing 10 via a pressure fitting 43 (cf. FIG. 5) inserted there.

Inclined guide webs 30, i.e., running diagonally to the longitudinal central axis 21 of the shaping unit 2, are provided in this sliding body 26, which are positively engaged with corresponding inclined guide strips 31, which are implemented on the two chucking segments 28 on their top and bottom sides in each case, and along which these guide webs 30 may slide. In this way, an axial movement of the sliding body 26 in the direction a is converted via the guide webs 30 and the guide strips 31 engaging therein into a radial movement (direction b) of the chucking segments 28.

The guide flanges 23 of the locking plate 18 are also engaged with projections 25 (FIG. 5), which are attached on the two chucking segments 28, on the front side and on the top and bottom thereof, whereby a displacement of the chucking segments 28 is possible laterally (i.e., in the direction b) and thus chucking of the workpiece 20 fed between the two chucking segments 28 is possible, but in contrast axial displacement of the chucking segments 28 (in the direction a) cannot occur.

Figure 6:
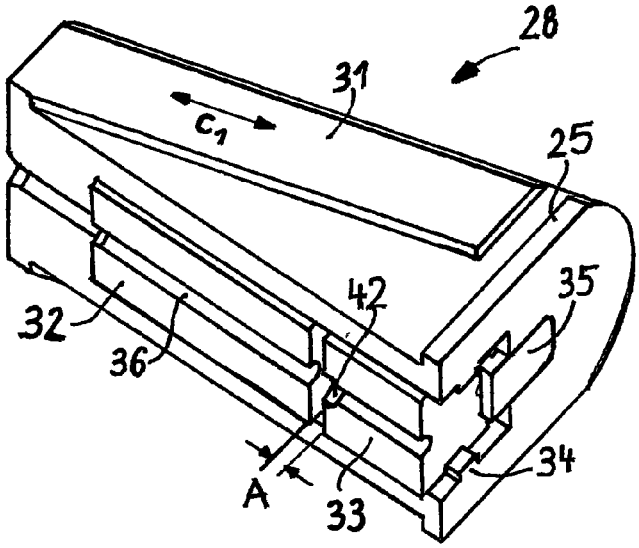
FIG. 6 shows an enlarged perspective view of a chucking segment having two inlaid clamping jaws.

As may be seen from FIG. 5 and in particular FIG. 6, in which such a chucking segment 28 is shown enlarged, two clamping jaws 32, 33 are received therein, each clamping jaw 32 or 33 being plugged onto guides 34 and then being inserted into a corresponding receptacle groove of the chucking element 28. In the exemplary embodiment shown, the length of this receptacle groove is somewhat greater than the total length of the clamping jaws 32 and 33 together. This has the result that after the front clamping jaw 32 is completely inserted between this and the other clamping jaw 33, an axial intermediate distance A remains. The second clamping jaw 33 is prevented from slipping axially out of the receptacle groove using a holding strip 35.

The distance A between both clamping jaws 32, 33 is maintained using a compression spring (not shown in the figures), whose two ends each engage in one pocket hole in the terminal faces of the two clamping jaws 32 and 33 facing toward one another and thus always bias tension them in their axially separated position from one another.

Each chucking segment 28 and its clamping jaws 32 and 33 have a groove 36 for receiving the workpiece 20, the profile shape of the groove 36 in the clamping jaws 32 and 33 being formed so that in the clamping position of the sliding body 26, when both chucking segments 28 are pressed radially against the workpiece 20, the greatest possible clamping force can be applied thereto.

It is to be noted here that instead of two clamping jaws 32, 33, only one clamping jaw can also be used, of course, for example, if only the workpiece end 41 (FIG. 3) is formed by the shaping ram 17 and otherwise no additional flare must be produced over the length of the workpiece 20.

The clamping jaws 32 and 33 are implemented so that they may be used on both sides, i.e., if one takes them from the receptacle groove of a chucking segment 28 and rotates them by 180° around their longitudinal axis, they may subsequently be used similarly in the other chucking segment 28. In this way, either a doubled service life is achieved or different workpiece diameters may be processed using one clamping jaw 32 or 33.

The function of the guide and centering unit 12 is also clear from the illustration of FIG. 2 and in particular FIG. 4.

Two L-shaped angles 37 are attached to the lid 11, opposing one another by 180°.

Furthermore, two levers 38 having guide jaws 39 are fastened so they are pivotable on the sliding body 26. The levers are connected to one another via a tension spring (not shown in the figures) so that they are located in a position pivoted radially outward under the spring bias tension (cf. FIG. 2 and FIG. 3).

In the event of an axial displacement of the sliding body 26 from its starting position (FIG. 3) into its clamped position (FIG. 4), the levers 38 slide on the angles 37 and are closed. The workpiece 20 is simultaneously centered in the shaping unit 2, before it is fixed and clamped by the clamping jaws 32 and 33 for the upsetting procedure.

However, the possibility also exists of replacing the sliding movement of the guide and centering unit 12 coupled to the axial movement of the sliding body 26, as shown in the figures, with another configuration, in which the closing movement of the levers 38 can be controlled directly and independently of the movement of the sliding body 26. The workpiece 20 can thus already be centered by the guide and centering unit 12 before beginning the closing movement of the chucking segments 28.

The upsetting module 2 can additionally also be equipped with a lubrication system, which prevents the danger of "chewing" on the tools, but which is not shown further in the figures.

Measuring systems may also be provided on the shaping unit 2, which are also not shown in the figures and which, for example, acquire the stroke of the shaping ram 17 or compression and/or clamping forces, in order to control and regulate the upsetting device 2 appropriately.

In the illustration according to FIG. 5, a waste slot 40 is also provided in the housing 10 below the terminal shaping, whereby workpiece or tool splinters may fall readily out of the housing 10 and out of the shaping unit 2, so that a breakdown of the apparatus by waste can be prevented in this way.

Using the shaping unit 2 shown, simple processing of the ends of the workpieces 20 is executed, as well as combined processing of both the end and also the production of flares in addition.

The work of the heading device 1 is to be explained hereafter on the basis of FIGS. 3 and 4:

A workpiece 20 is positioned in front of the shaping unit 2. The workpiece 20 is introduced into the shaping unit by the movement of the shaping unit 2 or also the workpiece 20 in the axial direction a. The sliding body 26 is moved hydraulically in the axial direction a out of its idle position and firstly closes the guide and centering unit 12 and subsequently the chucking segments 28, which clamp and fix the workpiece 20 via the clamping jaws 32 and 33. The cylinder 16 is then activated and the shaping ram 17 having the forming tool 24 is moved toward the second clamping jaw 33 and toward the protruding end 41 of the workpiece 20 and moves both in the direction a. The second clamping jaw 33 slides in its receptacle groove in the direction toward the other clamping jaw 32, the workpiece end 41 also being formed in accordance with the mold 38 in the forming tool 24 simultaneously with this movement and a flare 42 being produced between the two clamping jaws 32 and 33.

By retracting the shaping ram 17 and the sliding body 26, each into its starting position, the workpiece 20, which has been formed in the meantime, is released again. The two clamping jaws 32, 33 are simultaneously moved axially away from one another again by the distance A under the effect of the compression spring acting axially between them.

For the changeover of the shaping unit 2, reference is made to the enlarged perspective view of FIG. 5, which shows the area between the attachment plate 15 and the housing 10 so it is well recognizable.

In the position of FIG. 5, firstly the shaping ram 17 is moved into a completely retracted starting position, so that the forming tool 24 is no longer located in the hole 19 in the terminus plate 15.

In the case of the locking plate 18, which is fixed in the lateral direction in its position inserted into the housing 10 via a unit (not shown), the fixing is disengaged and the locking plate 18 is removed laterally (in the direction b). FIG. 5 shows this state.

The chucking segments 28 may also be pulled out of the sliding body 26 in the directions $c_1$ and $c_2$ and subsequently the clamping jaws 32 and 33 may be exchanged without any further tools.

As FIG. 5 shows, there is sufficient free space to also be able to attach a new forming tool 24 to the shaping ram 17, for example.

What is claimed is:

1. A heading device for an elongate workpiece, comprising:

a hydraulically actuated chucking unit comprising a housing having a sliding body which is hydraulically displaceable in an axial direction between a starting position and a clamping position, at least two chucking segments inserted within the sliding body, and a locking plate having an opening inserted within the housing and removeably fixed therein, wherein the at least two chucking segments are movable in a radial direction between an open position and a clamped position with the axial displacement of the sliding body toward the clamping position radially moving the at least two chucking segments toward the clamped position and the axial displacement of the sliding body toward the starting position moving the at least two chucking segments toward the open position, and each of the at least two chucking segments receiving at least one clamping jaw for holding the at least two chucking segments radially against the workpiece in the clamped position; and a shaping ram carrying a forming tool moveable in the axial direction between a retracted idle position and an extended compression position, wherein the shaping ram carrying the forming tool is moveable completely out of the opening in the locking plate when in the retracted idle position, and the shaping ram carrying the forming tool extending through the opening in the locking plate when in the extended compression position, and wherein the forming tool is capable of shaping a forward end of the workpiece protruding axially from the clamping jaws by compressing the forward end when moved to the extended compression position.

2. The heading device according to claim 1, wherein each of the at least two chucking segments has two clamping jaws situated axially one behind another.

3. The heading device according to claim 2, wherein there is an axial intermediate space between the two clamping jaws of each of the two chucking segments, the two clamping jaws are axially displaceable to one another and the two clamping jaws are pressed axially apart from one another using at least one compression spring.

4. The heading device according to claim 1, further comprising a hydraulic cylinder containing at least a portion of the shaping ram the hydraulic cylinder fastened to a terminus plate on a side facing away from the housing, and the terminus plate spaced apart a distance from the locking plate viewed in the axial movement direction of the shaping ram.

5. The heading device according to claim 4, wherein the distance between the terminus plate and the locking plate is greater than an axial length of each of the at least two chucking segments.

6. The heading device according to claim 1, wherein each of the at least two chucking segments has two guide strips lying parallel to one another with one of the two guide strips located on a top side of the chucking segment and the other guide strip located on a bottom side of the chucking segment, and wherein each of the two guide strips run inclined at an acute angle to the displacement direction of the sliding body and each of the two guide strips engage positively and displaceably in a guide groove of the sliding body.

7. The heading device according to claim 1, wherein the sliding body has a stop surface and the housing has a lid on a front side located in the axial direction opposite to the locking plate, the lid having a central opening for the passage of the workpiece, against which the stop surface of the sliding body presses in the starting position.

8. The heading device according to claim 7, wherein the lid comprises a guide and a centering unit for the workpiece attached on a side of the lid facing away from the housing.

9. The heading device according to claim 8, wherein the guide and centering unit for the workpiece comprises two pivot levers having guide jaws attached to an opening of the lid, wherein the two pivot levers are pivotable between an folded-out idle position and a centering position pressing against the workpiece.

10. The heading device according to claim 9, wherein the two pivot levers are pivotably connected to the sliding body in such a manner that the two pivot levers are in the folded-out idle position when the sliding body is in the starting position, and the two pivot levers are transferred into the folded-in centering position upon movement of the sliding body into the clamped position.

11. The heading device according to claim 9, wherein the two pivot levers are pivotable independently of the position of the sliding body.

12. The heading device according to claim 1, further comprising a framework attached to the hydraulically actuated chucking unit, and the hydraulically actuated chucking unit being movable on the framework in a longitudinal direction of the hydraulically actuated chucking unit.

13. A heading device for an elongate workpiece, the heading device having a central axis and comprising:

a hydraulically actuated chucking unit operably holding the workpiece, and a shaping ram configured to operably engage within at least a portion of the chucking unit, the shaping ram movable axially from a retracted idle position toward the workpiece in an extended working position and then back to the idle position, the chucking unit comprising a housing and a sliding body which is hydraulically displaceable in the axial direction of the workpiece within the housing from a starting position into a clamping position and then back to the starting position, the sliding body having at least one or more inclined surfaces with respect to the central axis, at least one chucking segment configured to be situated around the workpiece, each of the at least one chucking segments having an inclined surface engaged with one of the one or more inclined surfaces of the sliding body such that a displacement of the sliding body toward its clamping position moves the at least one chucking segment radially for clamping the workpiece, and a locking plate removeably fixed to the housing;

each of the at least one chucking segments positioned against the locking plate, the locking plate having an opening through which the ram extends when moving from its retracted position towards the work piece in the extended working position, the locking plate configured to be radially removable outwardly when the ram is at the retracted position, wherein when the locking plate has been removed outwardly, each of the at least one chucking segments may be moved axially and be removed from the heading device.

14. The heading device according to claim 13, wherein the locking plate is removeably fixed to the housing in such a configuration that each of the at least one chucking segments are removable from within the sliding body when the locking plate has been removed outwardly without any further removal of fasteners or disassembly being necessary for the removal of each of the at least one chucking segments.

15. The heading device according to claim 13, comprising two chucking segments, and each of the two chucking segments has two clamping jaws situated axially one behind another.

16. The heading device according to claim 15, wherein there is an axial intermediate space between the two clamping jaws of each of the two chucking segments, the two clamping jaws are axially displaceable to one another, and the two clamping jaws are pressed axially apart from one another using at least one compression spring.

17. The heading device according to claim 13, wherein the chucking unit further comprises a housing, the housing having a lid on a front side opposite to the locking plate with a opening for the passage of the workpiece, the housing having a stop surface of which the sliding body engages in its starting position.

18. The heading device according to claim 17, wherein the lid comprises a guide and a centering unit for the workpiece attached on a side of the lid facing away from the housing.

19. The heading device according to claim 18, wherein the guide and centering unit for the workpiece comprises two pivot levers having guide jaws attached to an opening of the lid, wherein the two pivot levers are pivotable between an folded-out idle position and a centering position pressing against the workpiece.

20. A method of changing out chucking segments of a heading device for an elongate workpieces, the heading device having a central axis and comprising:

a hydraulically actuated chucking unit having a housing and a plurality of chucking segments located within the housing that clamps the workpiece, a shaping ram configured to operably engage within at least a portion of the chucking unit, the shaping ram movable axially from a retracted idle position toward the workpiece in an extended working position and then back to the idle position, a locking plate removeably fixed to the housing, the locking plate with an opening through which the shaping ram extends except when the shaping ram has been moved to the retracted idle position, the plurality of chucking segments positioned against and retained in position by the locking plate, the locking plate removable radially from an operating position, the method comprising the steps of:

retracting the shaping ram to the retracted idle position, removing the locking plate from the operating position, and removing the plurality of chucking segments.

21. The method of claim 20 wherein the step of removing the plurality of chucking segments occurs directly after the step of removing the locking plate from the operating position and no removal of fasteners securing the chucking segments in the device are required after the removing of the locking plate.

* * * * *